US005333588A

United States Patent [19]

Cananagh

[11] Patent Number: 5,333,588

[45] Date of Patent: Aug. 2, 1994

[54] PUMP/INJECTOR

[75] Inventor: Eric J. Cananagh, Surbiton, England

[73] Assignee: Lucas Industries public limited company, Solihull, England

[21] Appl. No.: 5,634

[22] Filed: Jan. 19, 1993

[30] Foreign Application Priority Data

Jan. 21, 1992 [GB] United Kingdom ..... 9201204

[51] Int. Cl.[5] ..... F02M 37/04

[52] U.S. Cl. ..... 123/506; 123/500

[58] Field of Search ..... 123/500, 506, 501, 458, 123/446

[56] References Cited

U.S. PATENT DOCUMENTS

| | | | |
|---|---|---|---|
| 4,539,956 | 9/1985 | Hengel | 123/458 |
| 4,624,233 | 11/1986 | Phillips | 123/506 |
| 4,718,391 | 1/1988 | Rembold | 123/506 |
| 4,793,315 | 12/1988 | Phillips | 123/506 |
| 4,817,575 | 4/1989 | Hofer | 123/506 |
| 4,831,991 | 5/1989 | Cayot | 123/506 |
| 4,909,215 | 5/1990 | Müller et al. | 123/506 |
| 4,940,037 | 7/1990 | Eckert | 123/506 |

FOREIGN PATENT DOCUMENTS

| | | | |
|---|---|---|---|
| 241138 | 5/1960 | Australia | 123/506 |
| 0207652 | 1/1987 | European Pat. Off. . | |
| 4118236A1 | 12/1991 | Fed. Rep. of Germany . | |
| 0043148 | 3/1985 | Japan | 123/506 |

*Primary Examiner*—Carl S. Miller

*Attorney, Agent, or Firm*—Trexler, Busnell, Giangiorgi & Blackstone, Ltd.

[57] ABSTRACT

A pump/injector for supplying fuel to an internal combustion engine includes a pumping plunger reciprocable within a bore. The plunger and bore define a pumping chamber which is connected to the inlet of a fuel injection nozzle. The amount of fuel which flows to the nozzle is controlled by a pair of electromagnetically actuated spill valves of identical construction.

1 Claim, 1 Drawing Sheet

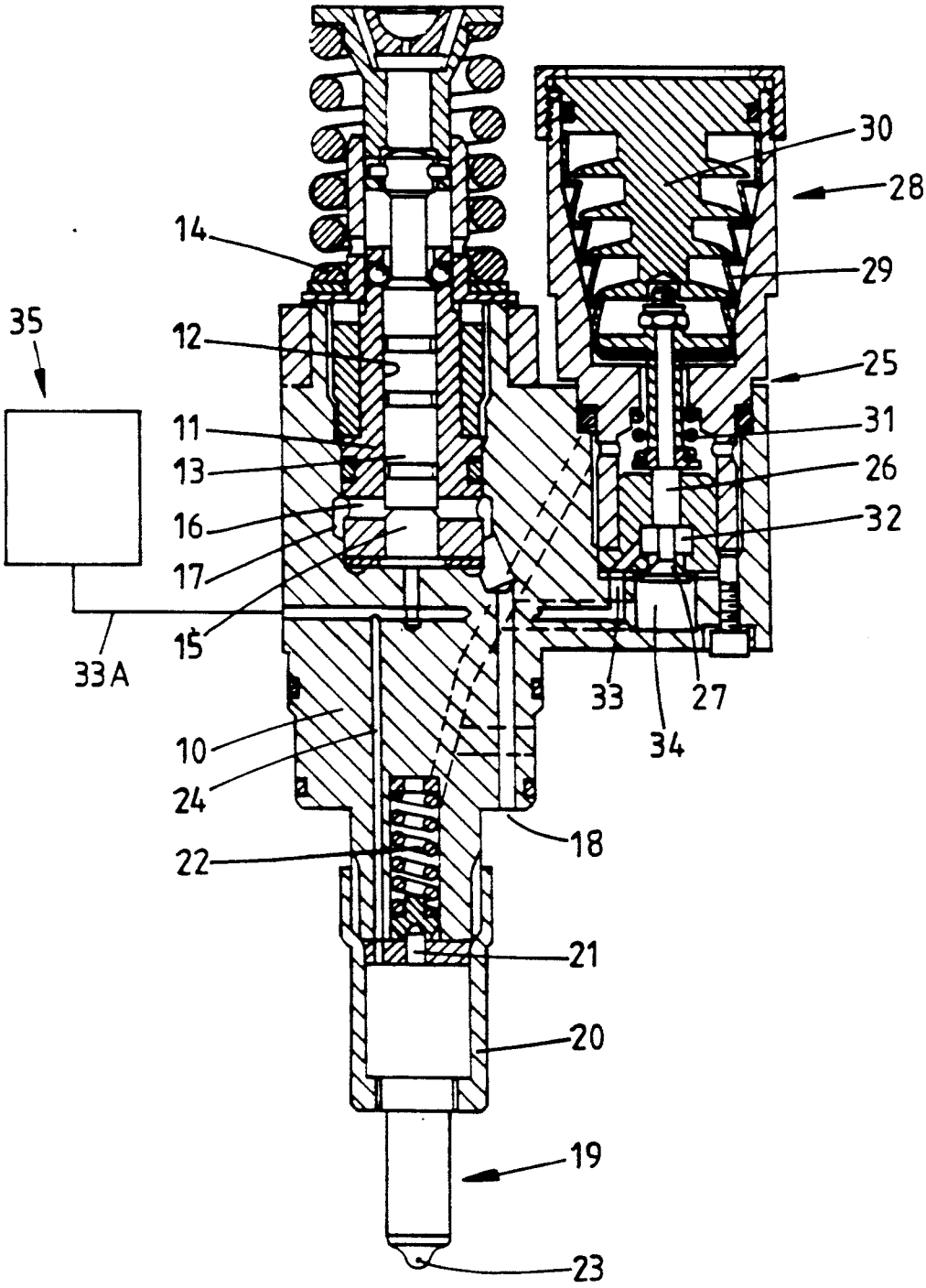
30
28
14
29
35
12
25
11
31
13
26
16
32
17
15
33A
33
27
34
10
24
18
22
21
20
19
23

PUMP/INJECTOR

This invention relates to a pump/injector for supplying fuel to an internal combustion engine, and comprising a reciprocable pump plunger housed within a bore defined in a housing, the bore and the plunger forming a pumping chamber from which fuel is expelled during an inward stroke of the plunger, means for filling the pumping chamber with fuel during outward movement of the plunger, a valve controlled fuel injection nozzle secured to the housing and having an inlet which is in communication with the pumping chamber and an outlet through which fuel flows when during inward movement of the pumping plunger, the valve member of the nozzle is lifted from its seating, a passage extending from the pumping chamber to a drain, and an electromagneticaiiy actuated spill valve in said passage and which can be operated to allow fuel to flow to the drain from the pumping chamber, during inward movement of the pumping plunger.

Pump/injectors of the aforesaid type are well known in the art and an example is seen in GB-A-2125115. The spill valve must be able to close during the inward movement of the plunger to initiate delivery of fuel so that the timing of fuel delivery to the associated engine can be controlled and it must also be able to open during the inward movement of the plunger so that the quantity of fuel delivered through the nozzle can be controlled. Prior to closure of the valve the area of the flow path through the valve must be sufficient to ensure that the fuel pressure at the inlet of the nozzle remains below the nozzle opening pressure. When the valve is closing the valve member thereof has to move against an increasing pressure which occurs due to restriction of the flow path. When the valve is opened the area of the flow path must be sufficient to ensure that the pressure at the inlet of the nozzle falls rapidly below the nozzle closing pressure to ensure that the valve member of the nozzle closes quickly.

It is possible to design a spill valve which fulfils the requirements above and which is of an acceptable size and power consumption. The spill valve is of the so called direct acting type and has its valve member mechanically coupled to the armature of the actuator. An 8 mm spill valve of this type is suitable for use with pump/injectors which have a pumping capacity of 700 cubic millimeters at 2000 RPM engine speed. If the pumping capacity is substantially increased a larger valve is necessary. However, the power requirement and the mass of the moving parts to achieve the same response time, is increased by approximately the cube of the scaling factor so that for example if a 16 mm valve is provided which would be suitable for pump/injectors having a pumping capacity of 2,500 cubic millimetres per stroke, the power requirement would be 8 times that of the 8 mm valve and the valve would also be much larger and more expensive.

It is known to utilise a servo system in which an electromagnetically operable valve controls the operation of a servo valve which when open provides an adequate flow path for the main volume of fuel displaced by the plunger, the remaining volume of fuel passing through the electromagnetically operable valve. Such systems can give satisfactory results but are expensive to produce.

The object of the present invention is to provide a pump/injector of the kind specified in a simple and convenient form.

According to the invention a pump/injector of the kind specified includes a further spill valve or spill valves operable in conjunction with the first mentioned spill valve, said further spill valve controlling flow of fuel through an additional passage from the pumping chamber to the drain.

An example of a pump/injector in accordance with the invention will now be described with reference to the accompanying drawing which shows part of the pump/injector in sectional side elevation.

Referring to the drawing the pump injector includes a housing 10 in which is located a pump barrel 11 in which is defined a bore 12. Slidable within the bore and extending therefrom is a pump plunger 13 which is movable inwardly by the action of an engine driven cam not shown and which is moved outwardly by the action of a coiled compression spring 14. The plunger and the bore define a pumping chamber 15. Opening into the bore is a pair of filling ports 16 which communicates with a fuel supply gallery 17 surrounding the pump barrel. The fuel supply gallery communicates with a fuel inlet 18 which in use is connected to a source of fuel under pressure.

The housing 10 also carries a fuel injection nozzle 19 which is retained relative to the housing by a cap nut 20. In known manner, the nozzle incorporates a spring loaded valve member a portion of which is seen at 21 and the valve member is biased to the closed position by the action of a spring 22. The nozzle has at least one outlet orifice 23 and also has a fuel inlet which is connected by means of a passage 24 to the pumping chamber 15.

Also provided is a spill valve which is generally indicated at 25 and this includes a valve member 26 which has a valve head 27 movable into engagement with a seating by an actuator 28. The actuator includes an armature 29 which is mechanically coupled to the valve member 26 and associated with the armature is a stator assembly 30 which includes a plurality of windings not shown. The valve member is biased to the open position by means of a spring 31. Beneath the head 27 of the valve member there is defined a chamber 32 which communicates with the pumping chamber 15 by way of a passage 33. Downstream of the valve head there is defined a further chamber 34 which communicates with a drain in the form of the fuel inlet 18.

The plunger is shown at its outermost position and the ports 16 are uncovered by the head of the plunger so that the pumping chamber 15 is completely filled with fuel from the supply gallery 17. As the plunger is moved inwardly by an engine driven cam, the ports 16 are covered by the plunger and then fuel will be displaced from the pumping chamber 15. If the spill valve is in the closed position as shown, the fuel will flow by way of the passage 24 to the inlet of the nozzle and will be at a pressure sufficient to lift the valve member of the nozzle from the seating against the action of the spring 22 and thereafter the fuel will be delivered through the outlet 23 to a combustion chamber of the associated engine.

The flow of fuel through the outlet 23 is terminated by de-energising the windings of the actuator 28 to allow the valve member 26 to move to the open position. This has the effect of lowering the pressure in the pumping chamber 15 and therefore the pressure of fuel which is supplied to the nozzle and the fuel which continues to be displaced by the plunger will flow to the fuel inlet 18. The instant at which the spill valve is opened, determines the quantity of fuel which is supplied to the engine and the start of delivery of fuel to the engine is determined by the instant of closure of the spill valve. As stated the valve member during closure has to move against an increasing fuel pressure within the pumping chamber as the flow area through the spill valve diminishes and when the valve is opened, the flow area through the spill valve must be sufficiently large to allow a rapid reduction in the pressure of fuel supplied to the nozzle.

The quantity of fuel which can be displaced by the plunger to the nozzle depends upon the stroke of the plunger following closure of the port 16 and also the area of the plunger. In order to cope with large displacements of fuel per stroke, it is proposed to provide a further spill valve this being diagrammatically illustrated at 35 to control flow of fuel through an additional passage 33A. The further spill valve is of identical construction to the valve 25 and it also is actuated by a similar actuator. By providing a pair of spill valves the flow area through which fuel can escape from the pumping chamber is increased. The physical size of each valve is the same and therefore for a number of applications valves of the same size can be manufactured and the appropriate number used to cope with the displacement of the plunger.

The further valve or valves can be operated in synchronism with the valve 25 however, it is possible and this is particularly useful at low speeds, to de-energise one valve before the other to obtain a reduced rate of spillage of fuel from the pumping chamber. Moreover, one valve can be energised slightly before the other to provide variation of the initial rate of delivery of fuel through the outlet 23. This is because the rise in pressure which is obtained as the valve members of the spill valves move into contact with their seatings, may be sufficient to raise the fuel pressure at the inlet of the injection nozzle to a value which is higher than the nozzle opening pressure, before actual engagement of the valve members with their seatings.

I claim:

1. A pump/injector for supplying fuel to an internal combustion engine comprising: a reciprocable pump plunger housed within a bore defined in a housing, the bore and plunger forming a pumping chamber from which fuel is expelled during an inward stroke of the plunger; means for filling the pumping chamber with fuel during outward movement of the plunger; a valve controlled fuel injection nozzle secured to the housing, the nozzle having an inlet which is in communication with the pumping chamber and an outlet through which fuel flows when, during the inward movement of the plunger, the valve member of the nozzle is lifted from its seating; a first passage communicating with said pumping chamber and with a drain; a first electromagnetically actuated spill valve in said first passage and which can be operated to allow fuel to flow to the drain from the pumping chamber, during the inward movement of the pumping plunger; and at least a second electromagnetically actuated spill valve operating simultaneously with the first spill valve, said second spill valve controlling flow of fuel through a second passage communicating with the pumping chamber and said drain, said first and second spill valves and said first and second passages being identical to each other.

* * * * *